US008506345B2

(12) United States Patent
Tigan et al.

(10) Patent No.: US 8,506,345 B2
(45) Date of Patent: Aug. 13, 2013

(54) DOLL AND HAT WITH INTERCHANGEABLE FEATURES

(76) Inventors: Jazz Tigan, Oakland, CA (US); Maricriz Perea, Oakland, CA (US)

( * ) Notice: Subject to any disclaimer, the term of this patent is extended or adjusted under 35 U.S.C. 154(b) by 0 days.

(21) Appl. No.: 13/244,563

(22) Filed: Sep. 25, 2011

(65) Prior Publication Data

US 2012/0073032 A1 Mar. 29, 2012

Related U.S. Application Data

(60) Provisional application No. 61/386,907, filed on Sep. 27, 2010.

(51) Int. Cl.
*A63H 3/02* (2006.01)
*A63H 33/00* (2006.01)

(52) U.S. Cl.
USPC ..... 446/369; 446/72; 446/372; 446/391

(58) Field of Classification Search
USPC ..... 446/369, 372, 391, 71, 72, 268
See application file for complete search history.

(56) References Cited

U.S. PATENT DOCUMENTS

| | | | | |
|---|---|---|---|---|
| 3,313,060 | A * | 4/1967 | Mobley, Jr. | 446/391 |
| 4,170,086 | A * | 10/1979 | Hills | 446/372 |
| 4,626,225 | A * | 12/1986 | Katzman et al. | 446/394 |
| 4,680,018 | A | 7/1987 | Ohno | |
| 4,781,648 | A * | 11/1988 | Garfinkel | 446/321 |
| 5,676,584 | A | 10/1997 | Perryman | |
| 5,788,554 | A | 8/1998 | Goodwin | |
| 6,887,120 | B2 | 5/2005 | Shamitoff | |
| 7,520,793 | B2 | 4/2009 | Pillai | |
| 8,011,991 | B2 | 9/2011 | Asperas | |
| 2007/0254555 | A1 | 11/2007 | Johnson | |

* cited by examiner

*Primary Examiner* — Kien Nguyen
(74) *Attorney, Agent, or Firm* — PatentBest; Andrew McAleavey

(57) ABSTRACT

A doll is disclosed. The doll has an outer layer that is constructed of a faux fur and that includes a number of openings. The faux fur has a pile height sufficient to at least partially conceal the openings. A number of interchangeable features can be connected to the outer layer by securing connecting members in the openings. Depending on the embodiment, the openings may be buttonholes or grommeted openings, and the connecting members may be buttons or connecting bars. Some embodiments of the doll may have a removable stuffed insert. When embodiments of the doll are not stuffed, or when the removable insert is removed, the doll may serve as a puppet, a hat, or a cover for an object.

20 Claims, 7 Drawing Sheets

DOLL AND HAT WITH INTERCHANGEABLE FEATURES

CROSS-REFERENCE TO RELATED APPLICATIONS

This application claims priority to U.S. Provisional Patent Application No. 61/386,907, filed Sep. 27, 2010. The entire contents of that application are incorporated by reference herein.

BACKGROUND OF THE INVENTION

1. Field of the Invention

The invention relates generally to the field of toys and amusement devices, and more particularly, to dolls and puppets with interchangeable features.

2. Description of Related Art

Dolls and toys with interchangeable faces, limbs, and other features have been popular for many years and continue to be popular. These sorts of dolls and toys allow the user to create features for the doll, usually including a face and sometimes also limbs, by selecting and connecting interchangeable features to a base structure. In general, the interchangeability may allow for a greater range of creative play.

One of the best-known toys with interchangeable features is MR. POTATO HEAD® (Hasbro, Inc., Pawtucket, R.I., United States), which is a rigid, potato-shaped plastic form that has holes in predefined positions to define a face and ears. Snap-fit plastic pieces are received in the holes. The interior of the plastic form provides storage space to hold the pieces when not in use.

A variety of U.S. patents also disclose dolls with interchangeable parts. For example, U.S. Pat. No. 6,887,120 to Shamitoff discloses a number of dolls with interchangeable parts, including faces and limbs.

One difficulty with many dolls and toys having interchangeable parts, including MR. POTATO HEAD® and the toys of the Shamitoff patent, is that the connectors and openings that are used to connect the interchangeable parts are quite visible, such that in order to appear complete, a part must be placed over every connector. This may limit creative possibilities with these toys to anthropomorphic faces and appendages.

SUMMARY OF THE INVENTION

One aspect of the invention relates to a doll. The doll has a body base structure with a number of receiving openings, which may be in the form of slit-like buttonholes. The body base structure is generally made out of a fabric, such as a faux fur, with a pile high enough to conceal the receiving openings. A number of features and appendages are also provided. Each of the features and appendages has a connecting piece on an end that is designed to be received in the receiving openings. The connecting piece may be, for example, a button. The button may be large relative to the size of the feature or appendage. The body base structure may be at least partially hollow or puppetlike in order to facilitate connection of the features and appendages from the reverse. In some embodiments, the body base structure may be reversible, with, for example, a different color of fabric on each side.

Another aspect of the invention also relates to a doll. The doll according to this aspect of the invention includes an outer covering portion made out of a fabric, such as a faux fur. The outer covering portion of the doll includes openings, and the faux fur has a pile height sufficient to at least partially conceal the openings. A removable, stuffed insert portion is sized and adapted to fit within the covering portion. A plurality of features have connecting members allowing them to be removably connected to the doll using the openings. Without the stuffed insert portion, the doll may be used as a hat.

Other aspects, features, and advantages will be set forth in the description that follows.

BRIEF DESCRIPTION OF THE DRAWING FIGURES

The invention will be described with respect to the following drawing figures, in which like numerals represent like features throughout the views, and in which.

DETAILED DESCRIPTION

Figure 1:
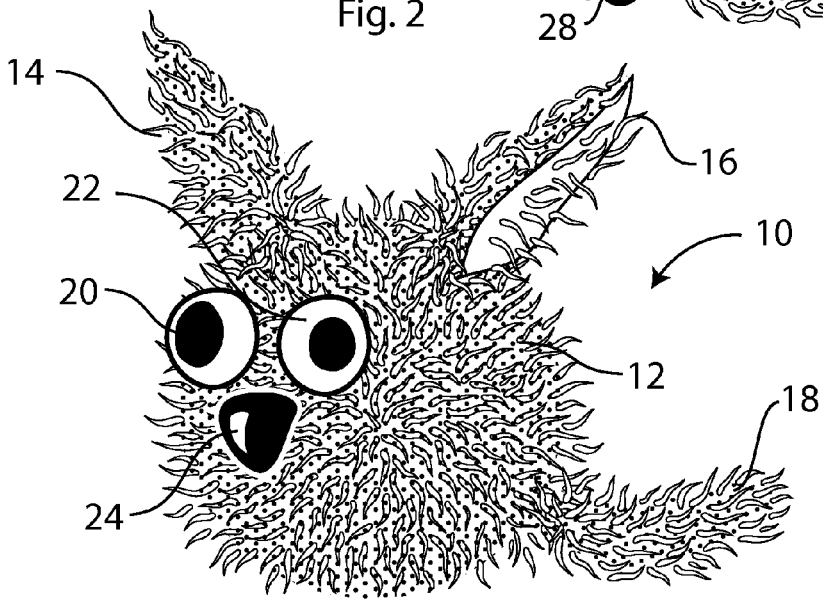
FIG. 1 is a perspective view of a doll according to an embodiment of the invention with selected features installed.

FIG. 1 is a perspective view of a doll, generally indicated at 10, according to one embodiment of the invention. The doll 10 has a base body structure 12 onto which a plurality of individual features have been installed. In the embodiment of FIG. 1, the installed features include individual ears 14, 16, a tail 18, left and right eyes 20, 22, and a nose 24. The base body structure 12 itself comprises at least one layer of fabric. In the illustrated embodiment, the outer fabric comprises a faux fur. The base body structure 12 may comprise any number of layers of fabric, including linings, and may also include filler material, such as poly-fill between layers, if desired. The layers of fabric may be sewn, adhered, or joined in any conventional manner.

The base body structure 12 may have essentially any shape, although in the illustrated embodiment, the base body structure 12 has a semi-hemispherical shape and is essentially hollow within. In other embodiments, portions of the base body structure 12 may be stuffed and closed, although it is advantageous to provide access to the reverse of the doll 10 in locations where features or parts are to be attached, as will be explained below in more detail.

Figure 2:
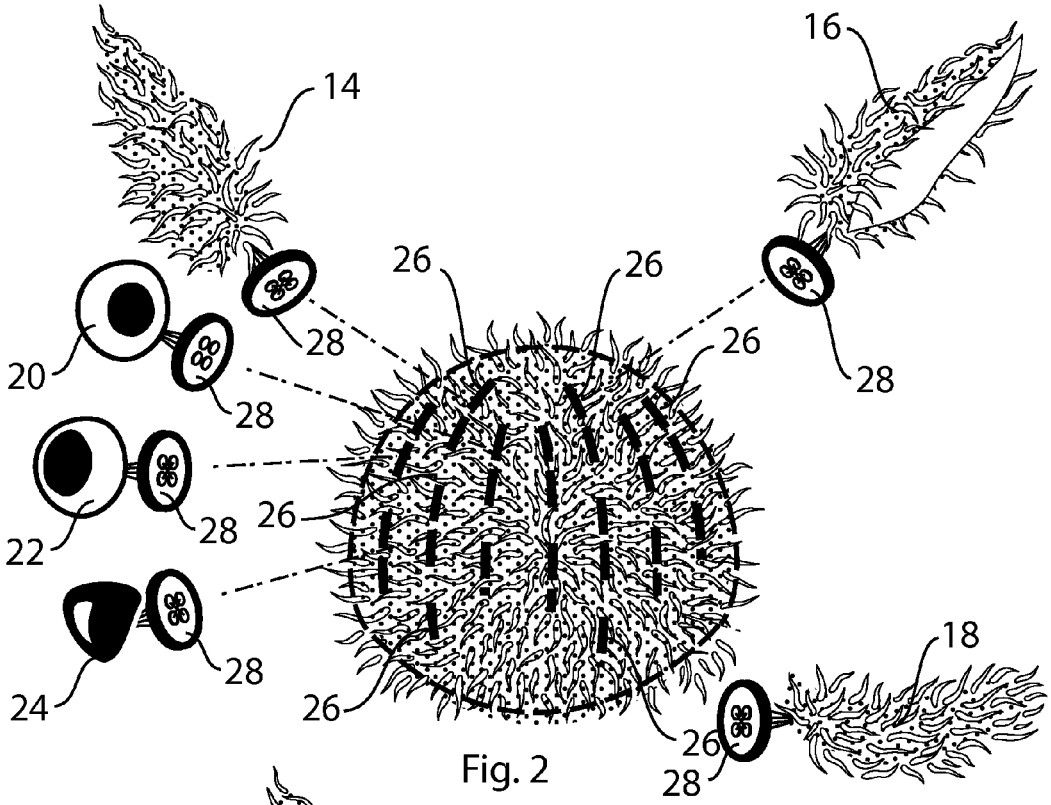
FIG. 2 is an exploded perspective view of the doll of FIG. 1, illustrating a variety of features that may be placed on the body base structure.

FIG. 2 is an exploded perspective view of the doll 10, illustrating the attachment of the various features. As shown, the base body structure 12 has a plurality of receiving openings 26, arranged in a pattern across the surface of the base body structure 12. (In the illustration of FIG. 2, the locations of the receiving openings 26 and the overall shape of the base body structure 12 are shown by broken lines.) The locations of the receiving openings 26 are such that features can be attached in the general shape and arrangement of a face, although it is advantageous if the receiving openings 26 are numerous, giving the user many options as to how many parts can be attached and where they can be attached.

In the illustrated embodiment, the receiving openings 26 have the general form of slits, and act as buttonholes. However, other types of receiving openings may be used in other embodiments. Any number of receiving openings 26 may be provided in the base body structure 12, so long as the number and size of the receiving openings 26 do not compromise the overall strength and durability of the fabric of the base body structure 12. The edges of the receiving openings 26 may be stitched or otherwise reinforced in any conventional manner so as to provide a clean, uniform, durable opening.

In embodiments of the invention, it is advantageous if the fabric of which the base body structure 12 is made has a pile of sufficient height and character to at least partially conceal the receiving openings 26. In some embodiments, particularly if the fabric is a fur or faux fur, the receiving openings 26 may be completely concealed, such that the base body structure 12 appears to be completely contiguous when there are no features installed on it. Faux fur may have a pile of 0.5 inches to 1 inch (1.25 to 2.5 cm), but a fabric with a pile of that height is not necessary in all embodiments. In some embodiments, a pile of 0.25 inches (0.5 cm) may be sufficient to effect concealment of the receiving openings 26.

Although the entire base body structure 12 of the illustrated embodiment is made of sewn or sewn and stuffed fabric, in some embodiments of the invention, portions of the base body structure 12 (or the entire structure) may be reinforced with plastic, malleable wire, wood, or metal stays.

As shown in the exploded view of FIG. 2, a variety of features may be attached to the base body structure 26. Many features may resemble human or animal features, such as the eyes 20, 22, nose 24, ears 14, 16, and tail 18 shown in FIGS. 1 and 2. Other features may include horns, antlers, and tentacles. However, some features may be entirely fanciful. In general, features may be made of plastic, fabric, plush, metal, or other materials. Each of the features 14, 16, 18, 20, 22, 24 is attached to an engaging member 28. In the illustrated embodiment, the engaging member 28 has the general form of a round button of a size and characteristics that match the characteristics of the receiving openings 26. The engaging members 28 would typically be stitched to their respective features 14, 16, 18, 20, 22, 24, and appropriate holes would generally be provided in non-fabric and non-plush features to accommodate the stitching.

In some embodiments, an appropriate engaging member may be secured to a feature by adhesives, fusing, or in some other manner. For example, a kit may be provided that includes a peel-and-stick adhesive pad connected to an engaging member 28, such as a button, so that engaging members 28 may be attached to essentially any element, thus making any element a potential feature to be added to the base body structure 12. Alternatively, if the feature in question is made of a material such as molded plastic, the engaging member may be formed integrally with the feature. In some cases, a thinned webbing of material may be provided between the feature and the engaging member so that the feature can be bent or otherwise manipulated relative to the engaging member.

If the engaging members 28 are buttons, the buttons may be relatively large—for example, on the order of 0.5 inches to 1 inch (1.25 to 2.5 cm) in order to make them easy to manipulate, even with limited dexterity. Additionally, as can be seen in the exploded view of FIG. 2, the buttons 28 may be the same size, regardless of the size of the features 14, 16, 18, 20, 22, 24 to which they are attached. This may make it easier for a user to pick up and attach features 14, 16, 18, 20, 22, 24 to the base body structure regardless of their size.

Figure 3:
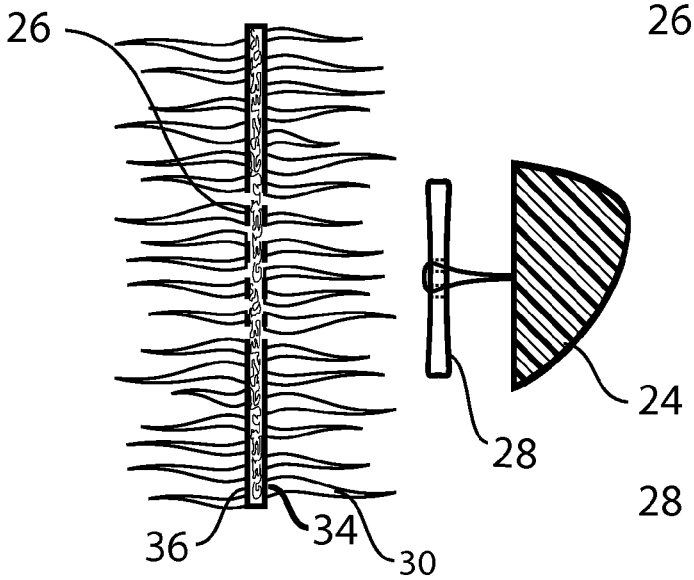
FIGS. 3 and 4 are cross-sectional views illustrating the connection of a feature with the body base structure of the doll of FIG. 1.
Figure 4:
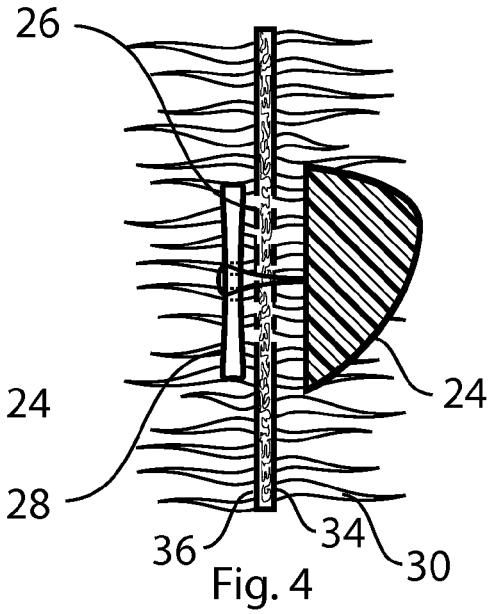

FIGS. 3 and 4 are cross-sectional views illustrating the attachment of a feature 24 to the base body structure 12. As shown, the receiving opening 26 is concealed by a relatively high pile 30. With the button 28 inserted into the receiving opening 26, the feature 24 is removably secured to the base body structure 12. The pile 30 is high enough to conceal the receiving opening 26, such that the feature 24 appears to rest on the surface of the base body structure 12. Access from the rear or inside of the base body structure 12 can help a user to locate the receiving openings 26 and seat the engaging members 28 in the openings 26.

As is also evident from the views of FIGS. 3 and 4, the base body structure 12 of the illustrated embodiment is double-sided and reversible. More particularly, layers 34, 36 of exterior fabric material, in this case a faux fur, are sewn back to back, such that either side of the base body structure 12 can be the exterior. Embodiments of the invention need not be reversible, but if they are reversible, the two layers 34, 36 of exterior material may have different characteristics. For example, the two layers 34, 36 may have different colors, different textures, or different pile heights.

Figure 5:
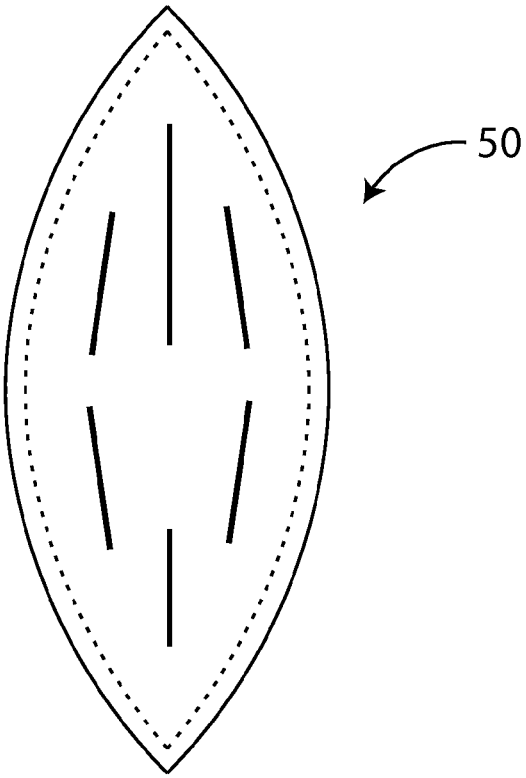
FIG. 5 illustrates one leaf or portion of a sewing pattern for a semi-hemispherical doll according to an embodiment of the invention.

FIG. 5 illustrates a portion of a pattern 50 for the base body structure 12. Six pieces of fabric cut from the leaf-like patterns 50 can be sewn together to create a generally hemispherical shape for the base body structure 12. If the base body structure 12 is being made reversible, the pieces of fabric would be sewn back-to-back.

Although the above description focuses on the use of attachable features, in some embodiments, the base body structure 12 may include sewn-in or permanently attached features, such as arms, legs, or a mouth that can open and close. As was described above, the base body structure 12 in many embodiments may be at least partially hollow. A base body structure 12 that is at least partially hollow may facilitate use of the doll 10 as a puppet, since a user can move his or her hand within the base body structure 12 to move it, and can, for example, grab the engaging members 28 to manipulate the features 14, 16, 18, 20, 22, 24 to which they are attached. In some cases, features may be attached by multiple engaging members 28 so as to provide more points for the user to grab and manipulate.

Figure 6:
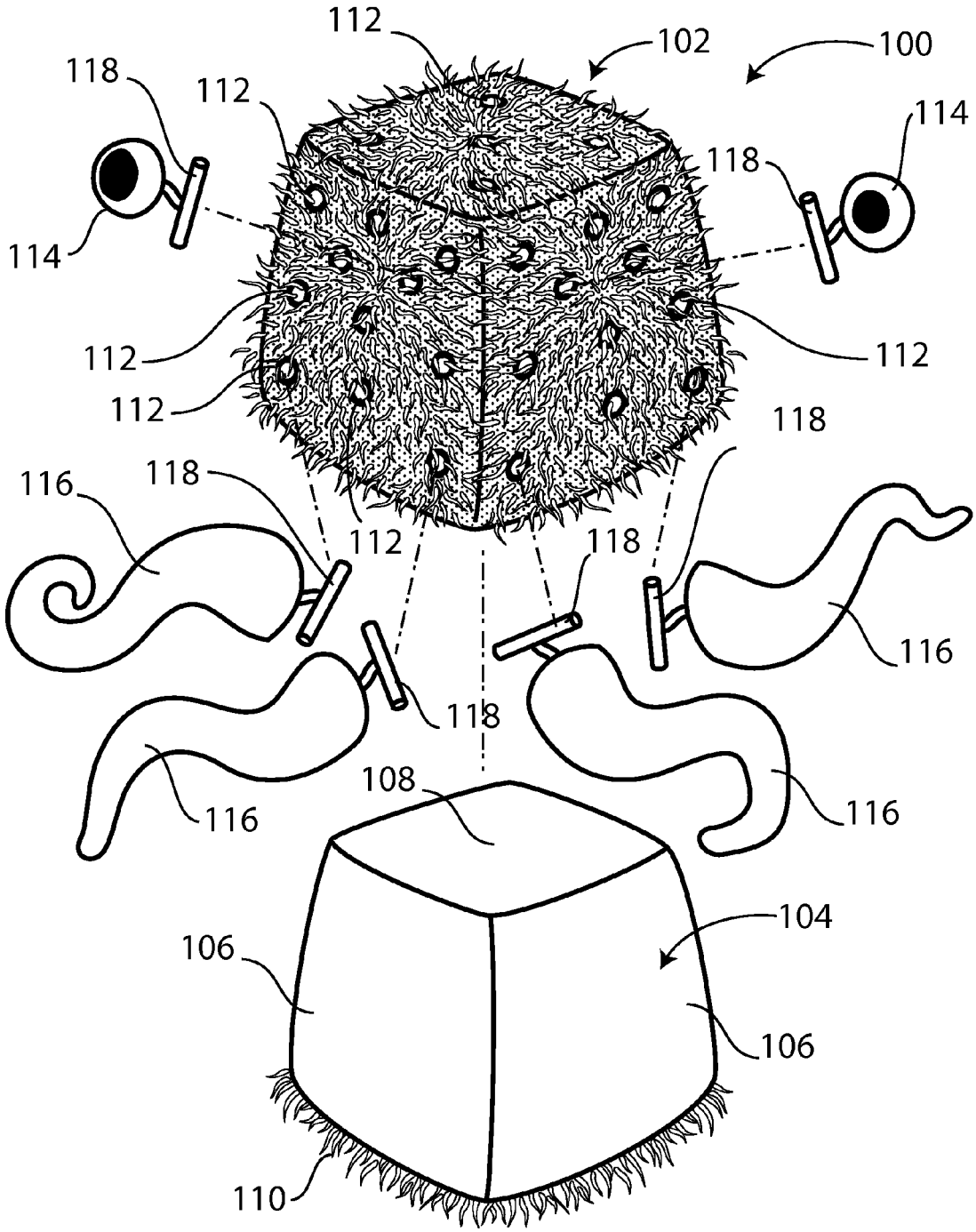
FIG. 6 is an exploded perspective view of a doll according to another embodiment of the invention.
Figure 7:
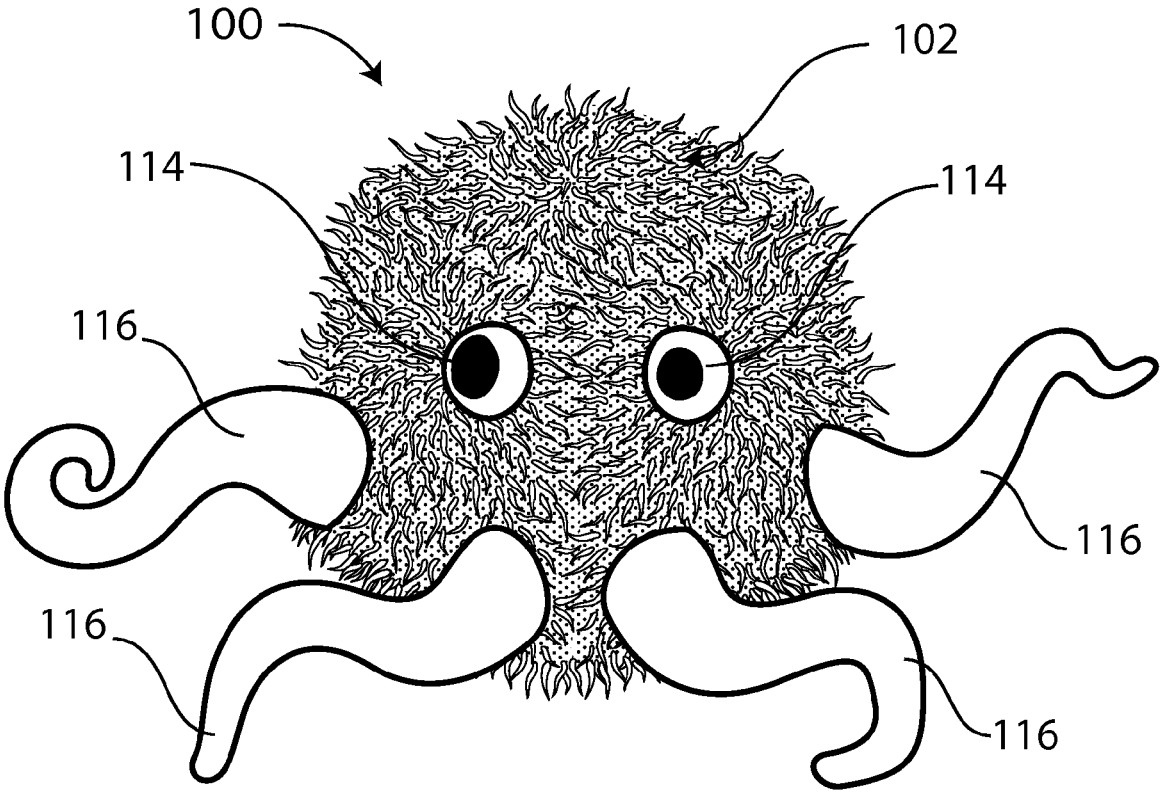
FIG. 7 is a perspective view of the doll of FIG. 6 with features installed.

FIG. 6 is an exploded perspective view of a doll, generally indicated at 100, according to another embodiment of the invention, and FIG. 7 is a perspective view of the doll 100 with features installed. The doll 100 has a covering portion 102 and an insert portion 104.

The covering portion 102 comprises a layer of faux fur, similar to the doll 10 of FIGS. 1-5. In addition to the faux fur, the covering portion 102 may include one or more layers of backing material, such as felt material. The covering portion 102 defines an internal cavity (not shown in FIGS. 6-7).

The insert portion 104 is a filled or stuffed element that can be removably inserted into the cavity in the covering portion 102. In the illustrated embodiment, the insert portion 104 has the general shape of an overstuffed rectangular or trapezoidal prism. However, the insert portion 104 may have any shape, although it may be preferable if the shape of the insert portion 104 at least substantially matches the shape of the cavity in the covering portion 102. The side faces 106 and top face 108 of the insert portion 104 may be comprised of the same material used for a lining or backing in the covering portion 102. In the illustrated embodiment, the outer layer of the bottom face 110 is comprised of the same faux fur used in the covering portion 102. The insert portion 104 may be stuffed with polyester fiber fill, foam, beads, particles, or any other conventional filler.

As shown in FIG. 6, like in the previous embodiment, the covering portion 102 includes a number of openings 112 in its top and side faces. Although the doll 100 may use slit-openings and buttons to secure features, like in the doll 10 of FIGS. 1-5, the openings 112 of the illustrated embodiment are round openings that are grommeted. (In the view of FIG. 6, the size and features of the openings 112 are exaggerated.) Opening sizes of about 0.25 inches to about 0.375 inches have been found to be particularly appropriate, although other sizes may be used. If the openings are too small, it may be difficult to define the openings in a high-pile fabric. If the openings are too large, the pile of the fabric may not be sufficient to conceal them.

The covering portion 102 is thus adapted to secure a wide variety of features in locations of a user's choice, including, as shown in FIGS. 6-7, eyes 114 and tentacle-like appendages 116. Of course, the shape and nature of the features is not limited, and appendages like those used in the doll 10 of FIGS. 1-5 may be used in the doll 100. FIG. 7 illustrates these features 114, 116 installed on the covering portion 102.

However, the method of securement and the engaging member itself differs somewhat from that of the previous embodiment. Specifically, in the illustrated embodiment, each feature 114, 116 has a bar 118 attached, for example, by a thin strip of fabric. The bar 118 is sized so that it can be removably inserted into the openings 112 to secure the feature 114, 116 to the covering portion 102. Typically, this would be done with the insert portion 104 removed, so that the covering portion 102 is accessible from its reverse side.

Figure 8:
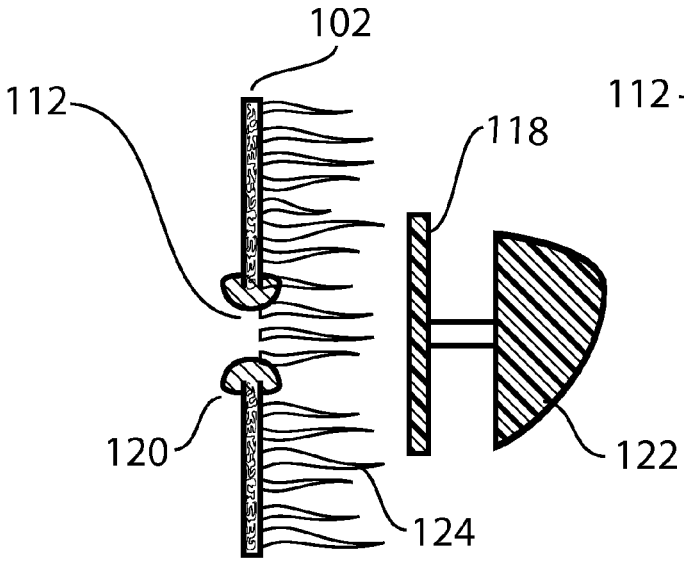
FIG. 8 is a plan view of an unsewn portion of the doll of FIG. 6, illustrating a pattern for its construction.
Figure 9:
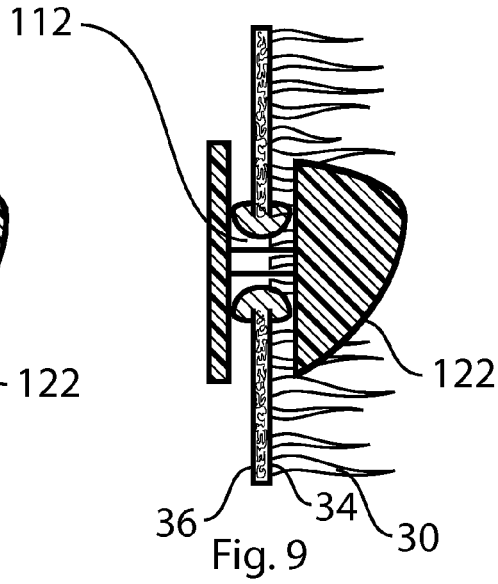
FIGS. 9 and 10 are cross-sectional views illustrating the use of grommeted openings and rods to attach features to the doll of FIG. 6.

FIGS. 8 and 9 are sectional views of the covering portion 102, illustrating the manner in which the features 114, 116 are installed. The feature 122 shown in FIGS. 8-9 is a nose, although in most embodiments, all of the features 114, 116, 122 will be installed in the same manner. Typically, the bar 118 attached to the feature 122 is brought into the proximity of the grommeted opening 112 and inserted through the grommet 120 one end at a time. The final resting position of the feature 122 is shown in FIG. 9. As with the previous embodiment, the faux fur 124 has a pile height sufficient to conceal the openings 112.

Figure 10:
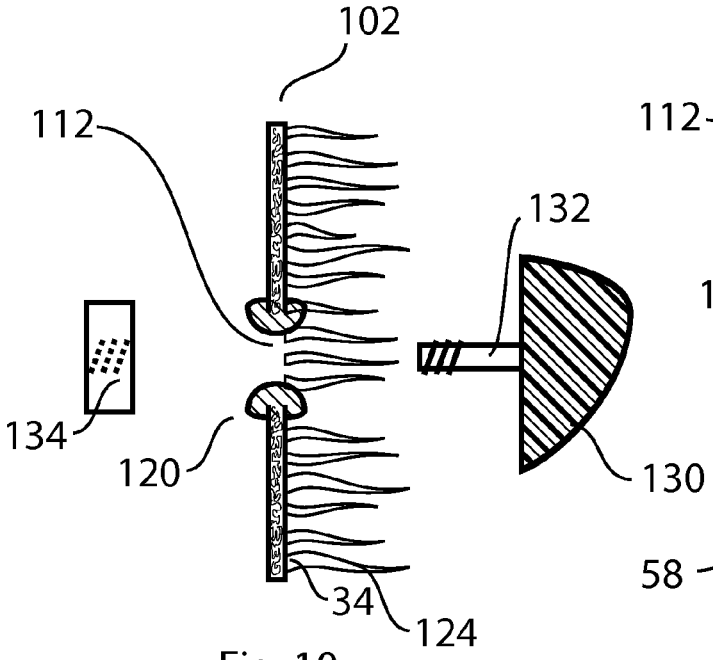
Figure 11:
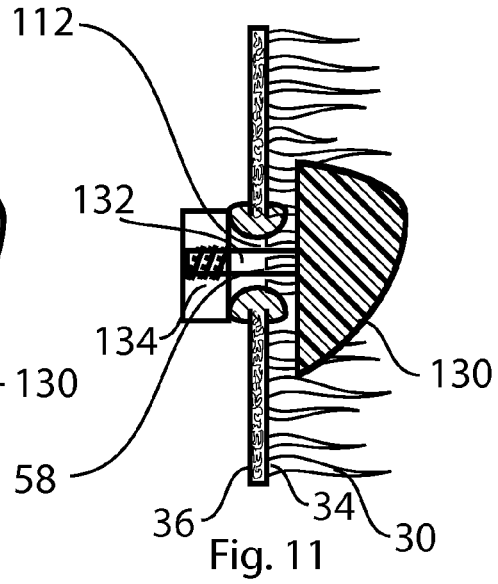
FIGS. 11 and 12 are cross-sectional views illustrating the use of a threaded post fastening system to attach features to the doll of FIG. 6.

FIGS. 10 and 11 are sectional views similar to the views of FIGS. 8 and 9, illustrating a slightly different attachment system for features. The feature 130 of FIGS. 10 and 11 has a threaded post 132 instead of a bar 118. In order to secure the feature 130, the threaded post 132 is inserted directly through the grommeted opening 112 and secured with a cap 134 of appropriate diameter that has internal threads corresponding to those on the threaded post 132. Other ways of securing features may also be used.

It should be understood that the term "feature" may encompass a number of articles and attachments. For example, hats, coverings, and other decorations may all be attached to the doll 100 using appropriate connectors, like the bar 118 and threaded rod 132. In cases where the feature is particularly large, it may be attached to the covering portion 102 with more than one connector. As was described above, connectors 118, 132 and engaging members of various types may be attached to non-plush or other features by any means, including adhesive pads or fasteners, such that essentially any item can be used as a feature. Additionally, although the connectors shown in FIGS. 8-11 are all male-to-female types of connectors, in some cases, a male-to-male connector may be provided, using buttons, bars, rods, or some other structure, in order to connect two dolls 10, 100 or two covering portions 102 together.

Figure 12:
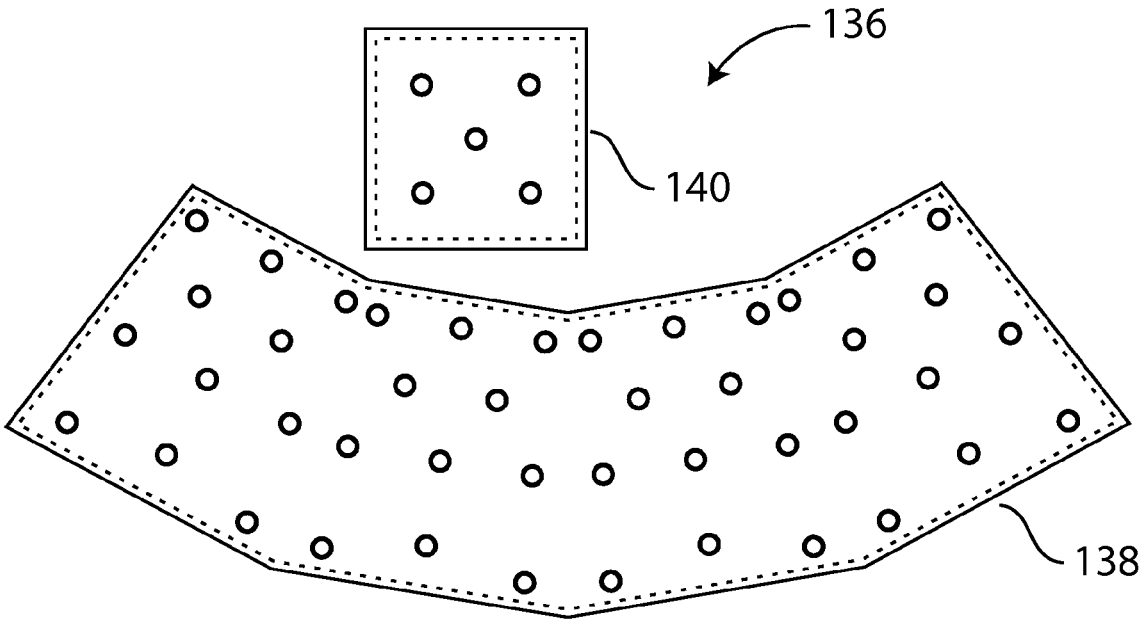

As can be seen from the figures, while the doll 10 of FIGS. 1-5 has a semi-hemispherical shape, the doll 100 has a more rectilinear shape that is closer to that of a frustum or trapezoidal pyramid. FIG. 12 illustrates a pattern, generally indicated at 136, that may be used to sew the covering portion 102 and the insert portion 104. The pattern 136 comprises a longer strip 138 cut so that it will form four generally trapezoidal sidewalls when folded appropriately. A square of fabric 140 is sewn along the top of the longer strip 138 to complete the shape.

Figure 13:
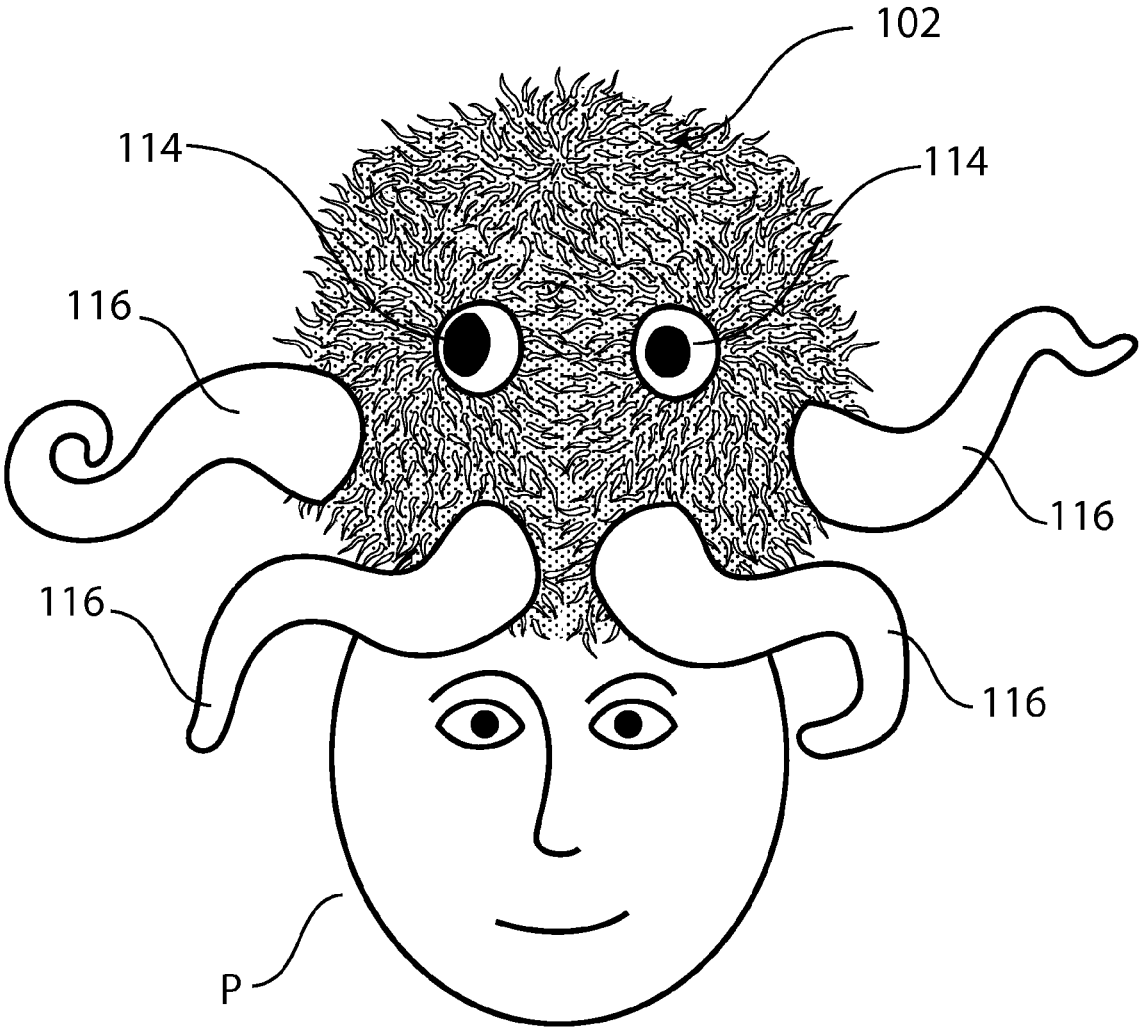
FIG. 13 is a front elevational view illustrating the use of the doll of FIG. 6 as a hat.

One advantage of the separate covering portion 102 and insert portion 104 is that with the insert portion 104 removed, the covering portion 102 can be used in a variety of ways. As was noted above with respect to the doll 10, the covering portion 102 of the doll 100 may be used alone as a puppet. Additionally, FIG. 13 is a front elevational view of a covering portion 102 on the head of a person P, being used as a hat. When used as a hat, or as a cover for an object, a covering portion 102 may have any type of features installed.

Although certain features have been described with respect to the doll 10 and others have been described with respect to the doll 100, many features can be used in either embodiment. For example, the doll 100 may use buttons and slit-openings as a means of securing features. Additionally, an insert portion may be provided for the doll 10, or the doll 100 may be reversible.

While the invention has been described with respect to certain embodiments, the description is intended to be exemplary, rather than limiting. Modifications and changes may be made within the scope of the invention, which is defined by the appended claims.

What is claimed is:

1. A doll, comprising:

a soft, flexible body structure including a plurality of receiving openings, the receiving openings having a generally slit-like shape and being arranged in a defined pattern or patterns across substantially the entirety of the body structure, the body structure including a first layer of exterior fabric with a pile height sufficient to at least partially conceal the receiving openings, the body structure being substantially hollow; and at least one feature having a connecting member attached thereto, the connecting member being larger than the receiving openings in at least one dimension and being sized and adapted to be received in the receiving openings to secure the at least one feature;

wherein the body structure includes an opening of sufficient size and location to permit access to the receiving openings from a reverse side thereof.

2. The doll of claim 1, wherein the features are selected from the group consisting of eyes, nose, mouth, ears, appendages, and tail.

3. The doll of claim 1, the body structure further comprising a second layer of exterior fabric with a pile height sufficient to at least partially conceal the receiving openings, the second layer of exterior fabric being arranged relative to the first layer of exterior fabric such that either the first layer of exterior fabric or the second layer of exterior fabric can serve as the exterior layer of the base body structure, rendering the base body structure reversible.

4. The doll of claim 1, wherein the at least one feature comprises a plurality of features, at least some of the plurality of features being different than one another.

5. The doll of claim 1, wherein the first layer of exterior fabric has a pile height of at least about 0.25 inches.

6. The doll of claim 5, wherein the first layer of exterior fabric has a pile height of about 0.5 inches to about 1 inch.

7. A plush doll, comprising:

a covering structure including a plurality of receiving openings arranged in a defined pattern or patterns across substantially the entirety of the covering structure, the covering structure including a first layer of faux fur with a pile height of at least about 0.25 inches, the sufficient to substantially conceal the receiving openings and being shaped so as to define an interior cavity;

a filled insert structure sized and dimensioned to fit within and fill the interior cavity of the covering structure, the insert structure being adapted to be removable and replaceable; and at least one feature removably connected to the covering structure through at least one of the receiving openings;

wherein the arrangement of the filled insert structure and the covering structure is such that removal of the filled insert structure permits access to the receiving openings from a reverse side thereof.

8. The doll of claim 7, wherein the receiving openings are grommeted.

9. The doll of claim 7, wherein the at least one feature is selected from the group consisting of eyes, nose, mouth, ears, appendages, and tail.

10. The doll of claim 9, wherein the at least one feature comprises a plurality of features, at least some of the plurality of features being different from one another.

11. The doll of claim 7, wherein the first layer of faux fur has a pile height of about 0.5 inches to about 1 inch.

12. A doll, comprising:

a soft, flexible body structure including a plurality of receiving openings defined in an exterior layer of faux fur with a pile height of at least about 0.25 inches, the pile height being sufficient to substantially conceal the receiving openings, the receiving openings extending through the body structure to an interior thereof and being arranged in a defined pattern or patterns across substantially the entirety of the body structure, the body structure having a shape that is generally rectilinear and being generally hollow with an interior cavity having an external opening that permits access to the receiving openings through the interior cavity;

a plurality of features each having a connecting member attached thereto, the connecting member being larger than the receiving openings in at least one dimension and being sized and adapted to be received in the receiving openings to secure the feature to which it is attached, at least some of the plurality of features being different from one another; and an insert structure filled with a soft material, the insert structure having a generally rectilinear shape to match a shape of the interior cavity, the filled insert structure sized and dimensioned to fit within and fill the interior cavity of the covering structure, the insert structure being adapted to be removable and replaceable;

wherein the arrangement of the insert structure and the covering structure is such that removal of the filled insert structure permits access to the receiving openings from a reverse side thereof.

13. The doll of claim 12, wherein the external opening in the body structure is located on a bottom side thereof.

14. The doll of claim 13, wherein the external opening in the body structure is of sufficient size to admit a human head.

15. The doll of claim 12, wherein the generally rectilinear shape of the body structure and the insert structure is essentially the same and comprises a rectangular or trapezoidal prism.

16. The doll of claim 12, wherein the insert structure is overstuffed.

17. The doll of claim 12, wherein the plurality of features is selected from the group consisting of eyes, nose, ears, tail, horns, antlers, and tentacles.

18. The doll of claim 12, wherein the first layer of faux fur has a pile height of about 0.5 inches to about 1 inch.

19. The doll of claim 12, wherein at least some of the plurality of features are plush.

20. The doll of claim 12, wherein ones of the plurality of features are attached to their respective connecting members by thinned webbing of material, allowing ones of the plurality of features to be manipulated relative to their respective connecting members.

* * * * *